United States Patent [19]

Simpson

[11] Patent Number: 4,570,424

[45] Date of Patent: Feb. 18, 1986

[54] CINCH FOR A WESTERN SADDLE

[75] Inventor: Roy G. Simpson, Cookeville, Tenn.

[73] Assignee: Adams Plastics, Inc., Cookeville, Tenn.

[21] Appl. No.: 678,180

[22] Filed: Dec. 4, 1984

[51] Int. Cl.[4] ..... B68C 1/00

[52] U.S. Cl. ..... 54/23; 54/46

[58] Field of Search ..... 54/1, 37, 44, 46, 35, 54/23

[56] References Cited

U.S. PATENT DOCUMENTS

| | | | |
|---|---|---|---|
| 1,454,306 | 5/1923 | Wood | 54/1 |
| 3,348,362 | 10/1967 | Herrera | 54/23 |
| 4,434,604 | 3/1984 | Bird | 54/23 |

*Primary Examiner*—Robert Peshock
*Assistant Examiner*—Cary E. Stone
*Attorney, Agent, or Firm*—Luedeka & Neely

[57] ABSTRACT

A cinch for use with a western saddle of the type employing a front cinch and a flank cinch. A western saddle typically has a cinch strap located on the near-side (left side) of the saddle disposed forwardly from the saddle's center, and an off strap located on the off-side (right side) of the saddle in a position opposing the cinch strap. The cinch strap and off strap are used for attaching the front cinch. A flank cinch billet also extends from either side of the saddle near its rear for attaching to the flank cinch. The cinch disclosed includes a flexible front cinch member for attaching to and extending between the cinch strap and the off strap of the saddle and having a midsection for extending under the rib cage of the horse. The cinch of the present invention further includes flexible near-side and off-side flank cinch members which connect to the midsection of the front cinch member and extend outwardly and rearwardly to the flank cinch billets of the saddle. The near-side and off-side flank cinch members are connected to the midsection of the front cinch member to provide an interconnection area which conforms to the contours of the horse's rib cage and so that the flank cinch members extend along the rib cage of the horse.

5 Claims, 5 Drawing Figures

CINCH FOR A WESTERN SADDLE

The present invention relates to horse tack and particularly relates to a cinch for a western saddle.

BACKGROUND OF THE INVENTION

Generally, most western saddles have rigging for employing both a front cinch and a flank cinch. The front cinch typically employed is a multiple-stranded strap which extends under the rib cage of the horse and is connected to the cinch strap of the saddle on the near-side (left side as viewed by rider) and the off strap on the off-side (right side as viewed by rider). A flank cinch is typically a leather strap which is connected to flank cinch billets. The flank cinch billets extend from either side of the rear portion of the saddle and the flank cinch passes under the belly of the horse to keep the rear portion of the saddle down and to keep the saddle in place on the horse. The flank cinch thus enables a rider to more easily stand in the stirrups and is essentially indispensable for roping and competitive events such as barrel racing.

A flank cinch is generally kept in a position forward on the horses belly and away from its legs by tying the flank cinch to the front cinch with a cinch connector strap. There are problems associated with the use of a flank cinch and connector strap including the possibility for the connector strap sliding to an off-center position which potentially permits loosening of the flank cinch. A more serious problem results if the connector strap breaks. Not only does the flank cinch loosen but also the flank cinch can contact the horse's rear legs which can make the horse buck and potentially injure the rider. In general, a flank cinch and connector strap may cause chafing and a flank cinch often cannot be tightened around the belly of the horse as securely as desired because the horse cannot endure great amounts of pressure in the flank area.

It is accordingly an object of the present invention to provide a cinch for a western saddle. It is a further object to provide a unitary cinch for a western saddle for providing the functions of both the front cinch and a flank cinch. It is another object of the present invention to provide a cinch for attachment to the flank cinch billets of the saddle which primarily fits under and applies pressure to the rib cage instead of the flank area of the horse.

BRIEF DESCRIPTION OF THE DRAWINGS

These and other objects will become more fully apparent as the following description is read in conjunction with the drawings in which.

SUMMARY OF THE INVENTION

The present invention provides a cinch for a western saddle having a cinch strap, an off strap, and flank cinch billets. Generally, the cinch includes a flexible front cinch member for extending between and for attaching to the cinch strap and the off strap of the saddle to extend under the rib cage of the horse. The cinch of the present invention further includes flexible near-side and off-side flank cinch members for extending from the midsection of the front cinch member outwardly and rearwardly to the flank cinch billets on the off and near sides of the saddle and for connecting to the flank cinch billets. The off-side and near-side flank cinch members are secured to the midsection of said front cinch member to provide an interconnection area which conforms to the contours of the horse's rib cage and so that substantial portions of the flank cinch members are in contact with the horse's rib cage. A cinch connector strap is not needed with the cinch of the present invention.

DESCRIPTION OF A PREFERRED EMBODIMENT

Figure 1:
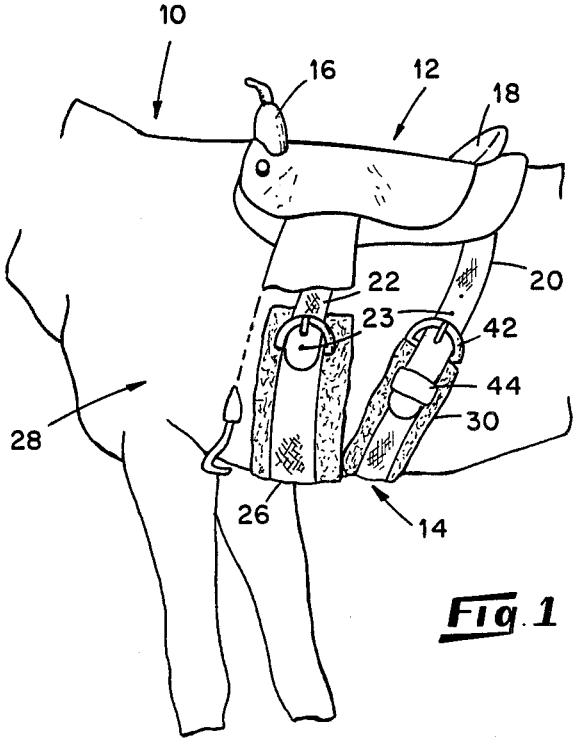
FIG. 1 is a partially broken-away, perspective view of a horse fitted with a saddle and one form of the cinch of the present invention viewed from the near-side.
Figure 2:
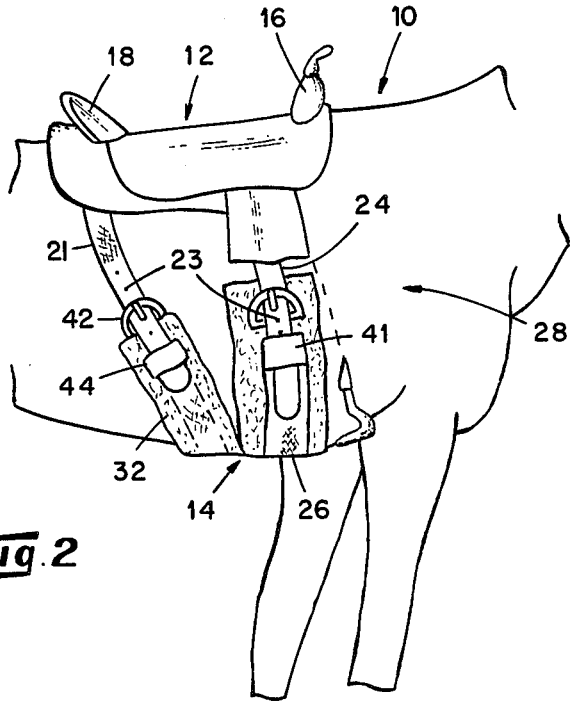
FIG. 2 is a partially broken-away view of the horse, saddle and cinch of FIG. 1 viewed from the off-side.

Referring now to the drawings in which like reference characters designate like or corresponding parts throughout the several views, there is shown in FIGS. 1 and 2 a partial view of a horse 10 on which is fitted a saddle 12 and a preferred form of the cinch 14 of the present invention. The saddle 12 is a western saddle having a horn 16 and cantle 18. The saddle 12 is of the type rigged to employ both a front cinch and a flank cinch and thus has near-side and off-side flank cinch billets 20 and 21, respectively. The saddle 12 has a conventional cinch strap 22 on the near-side as shown in FIG. 1 and off strap 24 on the off-side as shown in FIG. 2. The flank cinch billets 20 and 21, the cinch strap 22 and the off strap 24 each have holes 23 for receiving the tongue of buckles on a cinch. As shown in FIGS. 1 and 2, the cinch 14 of the present invention is connected to the saddle 12 by the flank cinch billets 20 and 21, the cinch strap 22, and the off strap 24 as will be described hereinafter.

Figure 3:
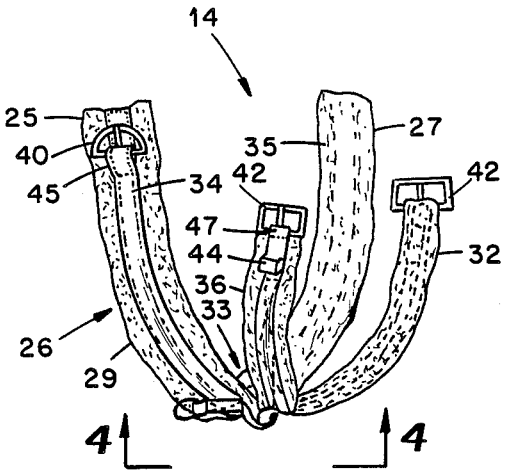
FIG. 3 is a perspective view of the cinch of FIG. 1 shown separately.

Referring now to FIG. 3, it is shown that the cinch 14 of the present invention includes a front cinch member 26 for attaching to and extending between the cinch strap 22 and the off strap 24. FIG. 1 shows that when the cinch 14 is fitted on the horse 10, the midsection 29 of the front cinch member 26 extends under the rib cage 28 of the horse 10. The front cinch member 26 is flexible and is made of a material which will not chafe the horse. As shown in FIG. 3, the cinch 14 of the present invention further includes a near-side flank cinch member 30 and an off-side flank cinch member 32. The near-side flank cinch member 30 is flexible and is made of a material which will not chafe the horse 10. The near-side flank member 30 is attached to the near-side flank cinch billet 20 and extends to the midsection 29 of the front cinch member 26. The off-side flank cinch member 32, is flexible, non-chafing and is attached to the off-side flank cinch billet 21. The off-side flank cinch member 32 extends from the off-side flank cinch billet 21 to the midsection 29 of the front cinch member 26.

Figure 4:
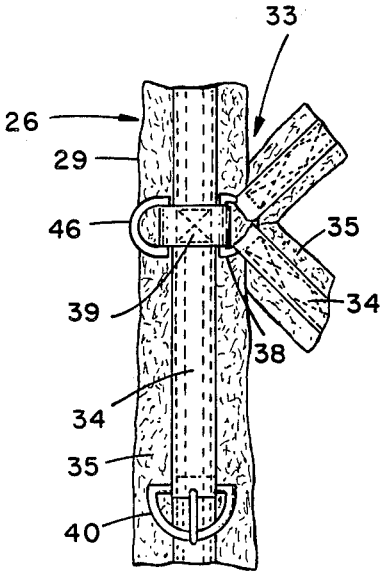
FIG. 4 is a detailed plan view of the under-side of the cinch shown in the preceding Figures viewed as indicated by line 4—4 of FIG. 3.
Figure 5:
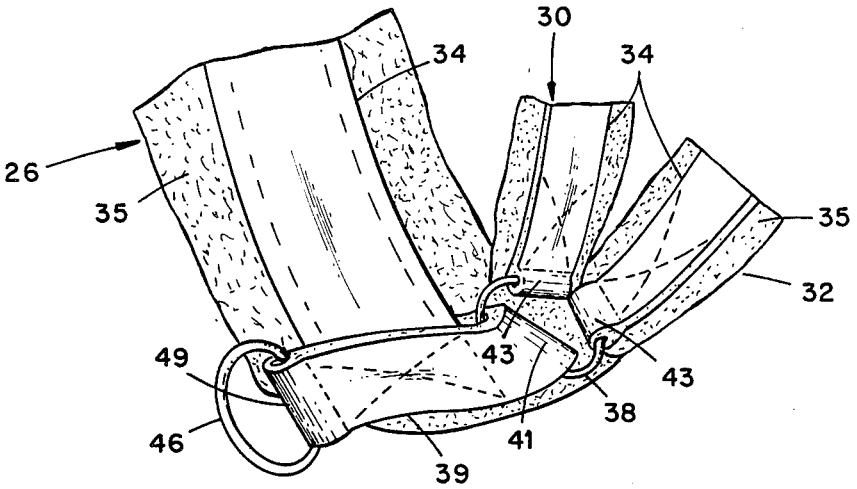
FIG. 5 is an enlarged, broken-away view of the cinch of FIG. 3.

As shown in FIGS. 3, 4 and 5 the near-side flank cinch member 30 and the off-side flank cinch member 32 are connected to the midsection 29 of the front cinch member 26 to provide an interconnection area 33 which is operable to conform to the contours of the horse's rib cage 28 and so that substantial portions of the flank cinch members 30 and 32 are in contact with the rib cage of the horse 10 when the cinch 14 is fitted on the horse 10. Preferably, the flank cinch members 30 and 32 are attached adjacent to the lowermost point of the midsection 29. Most preferably, the flank cinch members 30 and 32 are attached at a generally common position adjacent the lowermost point of the rearward edge of the front cinch member 26. When the cinch 14 is fitted on the horse 10, the near-side and off-side flank cinch members 30 and 32 thus extend upwardly and rearwardly from the generally common position to the flank cinch billets 20 and 21.

Referring still to FIGS. 3 and 4, it is shown that the preferred embodiment of the present invention includes a front cinch member 26 and flank cinch members 30 and 32 made from flexible woven straps 34 with a fleece lining 35 to prevent chafing. Preferably, the straps 34 are nylon and a synthetic fleece material, such as the material sold under the trademark Kodel manufactured by Eastman Kodak, is used. The fleece lining 35 should be wider than the straps 34 to prevent contact of the straps 34 with the horse. Suitable materials are 3-inch wide nylon straps for the front cinch member and 5-inch wide fleece lining. In the preferred embodiment, the straps 34 for the flank cinch members 30 and 32 are 2 inches wide and the fleece lining is about 2½ inches wide. Preferably, the lining 35 is sewn to the straps 34 with the strap being centered on the lining although other methods such as gluing may be used so long as secure attachment is provided.

As shown most clearly in FIG. 3, it is preferable for the flank cinch members 30 and 32 to be attached to the front cinch members 26 by means of a connector ring 38 which is attached adjacent to the midpont of the front cinch member 26. Use of a connector ring 38 enables the interconnection area 33 to adjust to the contours of the horse's rib cage and further permits the angles between the flank cinch members 30 and 32 to adjust to different horses and different saddles having different distances between the cinch strap and off strap 22 and 24, and the flank cinch billets 20 and 21. Preferably, the connector ring 38 is provided by a 2-inch D-ring as shown which is attached to the front cinch member 26 by means of a connector piece 39 made from a woven strap, preferably nylon, which is looped around the straight side of the D-ring to form a connector ring loop 41 and is sewn or otherwise securely attached to the front cinch member 26. The straight side of the D-ring is thus secured adjacent to the rearward edge of the strap 34 of the front cinch member 26. The flank cinch members 30 and 32 are preferably secured to the connector ring by flank cinch loops 43 which encircle the ring 38 and thus are free to slide along the ring 38 to provide for different angles between the flank cinch members 30 and 32 and the front cinch member 26. Most preferably, straps 34 used in the flank cinch members 30 and 32 are doubled-over their entire length and the loops 43 for encircling and receiving the connector ring 38 are thereby provided at the end of the doubled-over strap. In the preferred embodiment with the connector ring 38 being connected in the loops 43 in the nylon straps 34 and the loop 41 in the connector piece 39, the fleece lining 35 prevents the connector ring 38 from contacting the horse by suspending the ring 38 below the horse's rib cage at the interconnection area 33.

The front cinch member 26 has a tongued front cinch buckle 40 attached at both a near-side end 25 and an off-side end 27. Preferably, the cinch buckles 40 are held within cinch buckle loops 45, most preferably loops 45 are formed from loops of the straps 34 used for the front cinch member 26. Preferably, the loops 45 are spaced apart from the ends of the front cinch member 26. The front cinch buckles 40 are thus disposed on top of the nylon strap 34 and the fleece lining 36 adjacent the ends 25 and 27 and will not contact and chafe the horse. As shown in FIGS. 2 and 4, an off strap tuck loop 41 made of nylon strap is preferably provided for receiving the loose end of the off strap 24 of the saddle 12. The preferred embodiment of the cinch 14 of the present invention has tongued flank cinch buckles 42 for securing the flank cinch members 30 and 32 to the flank cinch billets 20. The flank cinch buckles 42 are preferably attached at the ends of the cinch members 30 and 32 and are secured by being held within flank cinch 47 loops in the straps 34. As previously noted, in the straps 34 of the flank cinch members 30 and 32 are preferably doubled-over along their entire length and loops 47 are also provided at the ends for the flank cinch buckles 42. Flank cinch tuck loops 44 also made of nylon straps are preferably provided adjacent the flank cinch buckles 42 to receive the ends of the flank cinch billets 20 and 21 of the saddle 12. The cinch 14 also includes a front ring 46 preferably attached with a front ring loop 49 in the connector piece 39 at the forward edge of the strap 34 of the cinch member 26. The front ring 46 is suitably provided by a 2-inch D-ring and is used to attach a breast collar or tie down to the cinch 14.

In use, the cinch 14 of the present invention is connected to the saddle 12 with the front cinch member 26 being attached to the cinch strap 22 and the off strap 24 by means of the cinch buckles 40, the tongues of which insert in an appropriate hole 23 in the straps. The near side flank cinch member 30 is attached to the near-side flank cinch billet 20 and the off-side flank cinch member 32 is attached to the off-side flank cinch billet 20 with the buckles 42 of the cinch 14. The tuck loop 41 and the flank cinch tuck loops 44 receive the ends of the off strap 24 and the flank cinch billets 20 and 21. The cinch strap 22, off strap 24 and the flank cinch billets 20 and 21 are adjusted by selection the appropriate holes 23 and inserting the tongues of the buckles 40 and 42 as desired.

The cinch 14 of the present invention is operable to hold the saddle 12 securely in position on the horse's back. In addition, the cinch 14 of the present invention is operable to hold the back of the saddle 12 down and thus enables a rider to more easily stand in the stirrups and provides the necessary stability for use during roping and competitive events such as barrel racing. Because the flank cinch members 30 and 32 are part of the cinch 14 and are fastened securely to the front cinch member 26, these members cannot come loose and contact the underbelly or legs of the horse to make him buck as can occur with conventional equipment. The interconnection area 33 conforms to the contours of the horse's rib cage and does not cause discomfort. In the preferred form of the present invention, the entire inner surface of the cinch 14 has a fleece lining 36 and the connector ring 38 is suspended below the horse's rib cage and does not contact the horse. Therefore, no chafing can occur. The major portions of the flank cinch members 30 and 32 rest on the horse's rib cage thus can be tightened to a greater degree than a flank cinch without any discomfort to the horse. The back of the saddle 12 is consequently held down much more securely than by conventional means. The cinch 14 is a unitary cinch providing the functions of both a front cinch and a flank cinch which is easily fitted on the horse and which is easily adjusted. Because the flank cinch members 30 and 32 are movable to different angles in relation to the front cinch member 26, the cinch may be used on different horses and with different saddles.

While a preferred embodiment of the present invention has been shown and described, it will be understood that there is no intent to limit the invention by such disclosure, but rather, it is intended to cover all modifications and alternate embodiments falling within the spirit and scope of the invention as defined in the appended claims.

What is claimed is:

1. For use with a western saddle having a cinch strap, an off strap, and flank cinch billets, a cinch comprising:

a flexible front cinch member for extending between the cinch strap and the off strap and having two ends for attaching to the cinch strap and the off strap of the saddle, said front cinch member having a midsection for extending under the rib cage of the horse;

flexible near-side and off-side flank cinch members for extending from the midsection of said front cinch member to the flank cinch billets on either side of the saddle and for attaching to the flank cinch billets; and means for securing said near-side and off-side flank cinch members to the midsection of said front cinch member with substantial portions of said flank cinch members extending along the rib cage of the horse and to provide an interconnection area for conforming to the contours of the horse's rib cage, said securing means securing said near-side and off-side flank cinch members adjacent to the lowermost point of said front cinch member;

whereby said near-side and off-side flank cinch members are operable to apply pressure to the rib cage of the horse to hold down the rear portion of the saddle.

2. The cinch of claim 1 wherein said securing means comprises a connector ring attached adjacent to the lowermost point of the front cinch member and loops formed in woven straps on said near-side and off-side flank cinch members for receiving said ring, whereby said loops slide on said ring to adjust the angles between said near-side and off-side flanks cinch members and said front cinch members.

3. The cinch of claim 2 wherein said front cinch member comprises a woven strap with a non-chafing lining of greater width than said woven strap and said near-side and off-side flank cinch members comprise a doubled-over woven strap with a non-chafing lining of greater width than said woven strap, said loops for receiving said connector ring being provided by a loop formed at the end of said doubled-over strap adjacent to said front cinch member.

4. The cinch of claim 3 wherein said connector ring is attached to said front cinch member with a connector strap comprising a woven strap providing a loop at the rearward edge of said woven strap of said front cinch member, whereby said ring is suspended above the horse's rib cage by said non-chafing lining so that said ring cannot contact the horse.

5. The cinch of claim 4 further comprising a front ring attached to said front cinch member at the forward edge of said front cinch member.

* * * * *